US011512869B2

(12) United States Patent
Chen et al.

(10) Patent No.: US 11,512,869 B2
(45) Date of Patent: Nov. 29, 2022

(54) AIR CONDITIONER INDOOR UNIT AND DOOR ASSEMBLY THEREOF

(71) Applicants: GD MIDEA AIR-CONDITIONING EQUIPMENT CO., LTD., Foshan (CN); MIDEA GROUP CO., LTD., Foshan (CN)

(72) Inventors: Liangrui Chen, Foshan (CN); Daijie Peng, Foshan (CN); Zhiqiang Yang, Foshan (CN); Wuzhong Wang, Foshan (CN); Hanjie Hu, Foshan (CN); Jianxiong Bai, Foshan (CN); Zeping Li, Foshan (CN); Shouliang Song, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 389 days.

(21) Appl. No.: 16/499,570

(22) PCT Filed: Mar. 28, 2019

(86) PCT No.: PCT/CN2019/080061
§ 371 (c)(1),
(2) Date: Sep. 30, 2019

(87) PCT Pub. No.: WO2020/172936
PCT Pub. Date: Sep. 3, 2020

(65) Prior Publication Data

US 2021/0325077 A1 Oct. 21, 2021

(30) Foreign Application Priority Data

Feb. 25, 2019 (CN) ..... 201910138758.4
Feb. 25, 2019 (CN) ..... 201920239378.4

(51) Int. Cl.
*F24F 13/08* (2006.01)
*E05F 15/635* (2015.01)
*F24F 13/20* (2006.01)

(52) U.S. Cl.
CPC ..... *F24F 13/084* (2013.01); *E05F 15/635* (2015.01); *F24F 13/20* (2013.01)

(58) Field of Classification Search
CPC ..... F24F 13/084; F24F 13/20; E05F 15/635
(Continued)

(56) References Cited

U.S. PATENT DOCUMENTS 5,042,269 A * 8/1991 Sullivan ..... F24F 13/20 62/285
6,343,436 B1 * 2/2002 Milano, Jr ..... E05F 15/67 49/362
(Continued)

FOREIGN PATENT DOCUMENTS

CN 104807109 A * 7/2015
CN 105135525 A 12/2015
(Continued)

OTHER PUBLICATIONS

World Intellectual Property Organization (WIPO) International Search Report and Written Opinion for PCT/CN2019/080061 dated Nov. 14, 2019 20 Pages.
(Continued)

*Primary Examiner* — Allen R. B. Schult
(74) *Attorney, Agent, or Firm* — Anova Law Group PLLC

(57) ABSTRACT

A door assembly for an air conditioner indoor unit includes a door mounting plate, including a receiving chamber having a fitting opening on one side and a bottom wall on another side, a door arranged adjacent to the bottom wall of the receiving chamber and configured to be movable toward
(Continued)

and away from the door mounting plate, and a plurality of driving assemblies arranged in the receiving chamber. An end of each driving assembly passes through the bottom wall of the receiving chamber to be connected to the door. Locations of the ends of the plurality of driving assemblies connected to the door are uniformly distributed on the door. The plurality of driving assemblies are configured to drive the door to move.

15 Claims, 14 Drawing Sheets

(58) Field of Classification Search
USPC ..... 454/367
See application file for complete search history.

(56) References Cited

U.S. PATENT DOCUMENTS

| | | | | |
|---|---|---|---|---|
| 7,530,189 | B2 * | 5/2009 | Kim | F24F 1/0057 40/725 |
| 2011/0275306 | A1 * | 11/2011 | Kim | F24F 13/062 454/339 |
| 2012/0003917 | A1 * | 1/2012 | Jeong | F24F 13/20 454/292 |
| 2016/0032942 | A1 | 2/2016 | Jung et al. | |
| 2017/0097162 | A1 | 4/2017 | Shin et al. | |
| 2018/0209687 | A1 | 7/2018 | Chun et al. | |
| 2018/0216835 | A1 | 8/2018 | Yun et al. | |

FOREIGN PATENT DOCUMENTS

| | | | |
|---|---|---|---|
| CN | 105485774 | A | 4/2016 |
| CN | 107062573 | A | 8/2017 |
| CN | 107702210 | A | 2/2018 |
| CN | 107835917 | A | 3/2018 |
| EP | 2894415 | A1 | 7/2015 |
| KR | 100897425 | B1 | 5/2009 |
| KR | 20140037985 | A | 3/2014 |
| KR | 101927885 | B1 | 12/2018 |

OTHER PUBLICATIONS

World Intellectual Property Organization (WIPO) International Search Report for PCT/CN2019/080061 dated Nov. 14, 2019 20 Pages.
The European Patent Office (EPO) Extended Search Report for EP Application No. 19778780.7, dated Jul. 28, 2020 8 Pages.
Japan Patent Office (JPO) Notice of Reason for Refusal For JP Application No. 2019-556328 dated Jul. 13, 2021 6 Pages (Translation Included).
Intellectual Property Office of Korea (IPKR) The Office Action For KR Application No. 10-2019-7030593 dated Nov. 19, 2020 13 Pages (Translation Included ).

* cited by examiner

AIR CONDITIONER INDOOR UNIT AND DOOR ASSEMBLY THEREOF

CROSS-REFERENCE TO RELATED APPLICATIONS

This application is a National Stage Entry under 35 U.S.C. § 371 of International Application No. PCT/CN2019/080061, filed Mar. 28, 2019, which claims priority to Chinese Application Nos. 201910138758.4 and 201920239378.5, both filed Feb. 25, 2019, the entire contents of all of which are incorporated herein by reference.

FIELD

The present application relates to the field of air processing equipment, in particular to a door assembly of the air conditioner indoor unit, as well as the air conditioner indoor unit having such door assembly.

BACKGROUND

In the relevant technology, the door of the air conditioner indoor unit has at least a single driving device to open or close the air outlet. However, the door of such structure has a large torque demand of the driving device, so it is easy to produce the problem of high noise and unstable operation of the driving device in the running process.

SUMMARY

The purpose of the present disclosure is to address at least one of the technical problems in the existing technology. For this purpose, the present disclosure proposes the door assembly of an air conditioner indoor unit, which features stable operation, low noise and long life.

The present disclosure also proposes the air conditioner indoor unit which includes the door assembly.

In accordance with the first embodiment of this aspect, the door assembly of the air conditioner indoor unit includes: the door mounting plate, where the door mounting plate has a receiving chamber which includes the fitting opening on one side while is closed on the other side to form the bottom wall of the receiving chamber; the door, where the door may move in the direction toward or away from the door mounting plate, and is mounted near the bottom wall of the receiving chamber; the driving assembly driving the door, where there are multiple driving assemblies which all are mounted in the receiving chamber, and one end of each driving assembly penetrates through the bottom wall of the receiving chamber and then is connected to the door, and one end of multiple driving assembly is arranged uniformly on the door.

For the door assembly of the air conditioner indoor unit according to embodiments of the present disclosure, the driving assembly is mounted in the receiving chamber which protects the former from being displaced or damaged after being subjected to the external force or violence, thereby extending the life of the door assembly. Further, one end of each driving assembly penetrates through the bottom wall of the receiving chamber, and then is connected to the door, that is, there is a solid wall between the driving assembly and the door, so that the bottom wall may support the driving assembly to some extent after one end of the driving assembly penetrates through the bottom wall of the receiving chamber, which thus can enhance the stability of the driving assembly driving the door. Moreover, the door is driven by several driving assemblies, which improves the moving stability of the door further, and reduces the torque of each driving assembly, thus lowering the noise of the door assembly.

Optionally, the door mounting plate includes: the frame, where the frame includes the vent channel; the mounting part, where the mounting part is mounted in the vent channel, the receiving chamber is formed on the mounting part and the fitting opening of the receiving chamber is located at the side of the mounting part away from the door; and the connection member, where the connection member is connected between the frame and the mounting part so as to fix the mounting part in the vent channel.

Optionally, there are several connection members which are connected between the inner walls of the mounting part and the vent channel respectively in radial pattern.

Optionally, there are three driving assemblies which are mounted respectively along three edges of an equilateral triangle.

Optionally, the driving assembly includes: the motor; the gear, where the gear is mounted at the shaft of the motor; and the rack, where the rack extends along the moving direction of the door, and meshes with the gear, and where one end of the rack penetrates through the bottom wall of the receiving chamber, and then is connected to the door.

Optionally, the driving assembly also includes: the housing, where the motor and the gear are both mounted in the housing, the rack can move in the housing and both ends of the rack penetrate through the housing to the outside of the housing.

Optionally, the driving assembly also includes: the connection part, where the connection part is mounted at one end of the door near the rack, is connected to the door and includes connection plate body which is connected vertically to the rack from one side; and the connection column which is mounted at another side of the connection plate body and is connected to the door in a detachable manner.

Optionally, there are several connection columns, at least one of which is connected to the door through the clip structure, while at least one of them is connected to the door through the threaded connection member.

Optionally, the door includes the baseplate and the cover plate, where the cover plate is mounted at the side of the baseplate away from the door mounting plate, and the cover plate is detachable relative to the baseplate; the door assembly also includes the guiding part, where the guiding part is mounted at the side of the baseplate near the door mounting plate, and the door mounting plate includes guiding groove in which the guiding part can move in the guiding groove.

Optionally, the baseplate has a projection part toward the cover plate in the middle, the projection part includes the mounting groove at the side away from the cover plate, and the guiding part is mounted in the mounting groove.

Optionally, the guiding part includes the end wall and the peripheral wall around the end wall both of which are contained in the mounting groove, and the peripheral wall is arranged movably in the guiding groove.

Optionally, the baseplate is connected to the guiding part in a detachable manner.

According to the second embodiment of this aspect, the air conditioner indoor unit includes: the outer box baseplate component, where the outer box baseplate component has one side open; the panel component, where the panel component is mounted at the open side of the outer box baseplate component, and the outlet is provided at the panel component; according to the door assembly of the air conditioner indoor unit mentioned above, the door mounting plate is mounted at the side of the panel component facing the outer box baseplate component, and the door can movably open and close the outlet, so that the door will be located at the side of the panel component away from the outer box baseplate component when the door opens the outlet.

Since the aforesaid door assembly has the above advantages, so the air conditioner indoor unit can have corresponding advantages by having the door assembly, that is, the door can open and close the air outlet more smoothly and stably, the door has stable movement, the noise is low and the air conditioner indoor unit enjoys extended service life.

Additional aspects and benefits of the present disclosure will be presented in the following sections, which will become apparent from the following descriptions or through the practice of the present disclosure.

BRIEF DESCRIPTION OF THE DRAWINGS

The above and/or additional aspects and advantages of the present disclosure will become apparent and easy to be understood from the description of embodiments in combination with the attached drawings below, where:

FIG. 13 and FIG. 14 are the schematic diagrams showing that the door is in the closed and open states respectively.

REFERENCE NUMERALS

Figure 1:
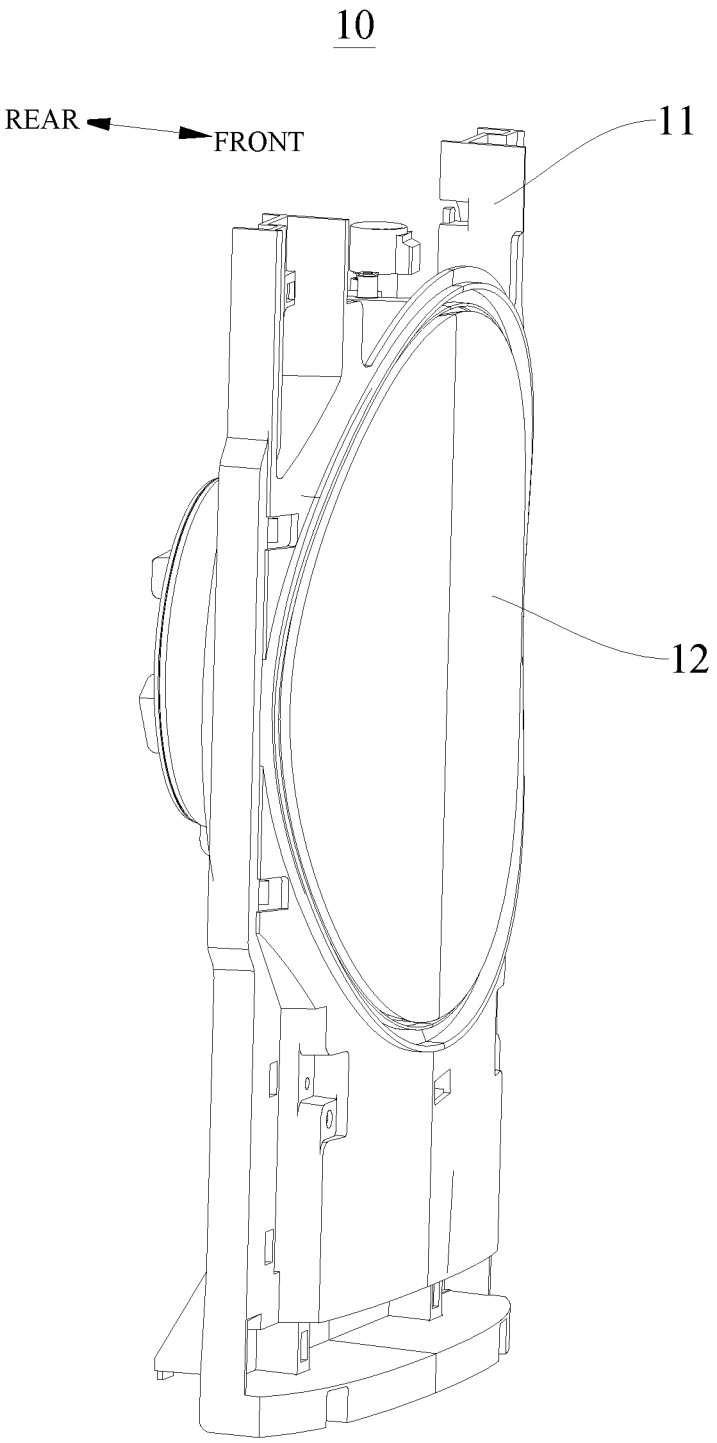
FIG. 1 is a structural diagram of the door assembly according to embodiments of the present disclosure, in which the door is in closed state.

Air conditioner indoor unit 100;

Door assembly 10;

Door mounting plate 11; receiving chamber 111; fitting opening 112; bottom wall 113 of receiving chamber; frame 114; vent channel 1141; mounting part 115; connection member 116; wiring channel 117

Door 12; baseplate 121; projection part 1211; mounting groove 1212; cover plate 122;

Driving assembly 13; motor 131; gear 132; rack 133; housing 134; connection part 135; connection plate body 1351; connection column 1352;

Seal cover 14; clip 141; clamping groove 142; wiring channel cover plate 143; projection groove 144;

Guiding part 15; end wall 151; peripheral wall 152;

Outer box baseplate component 20;

Panel component 30; first air outlet 31; second air outlet 32;

First fan 40;

Second fan 50; wind wheel 51; driving motor 52; motor protection part 53.

DETAILED DESCRIPTION

The embodiments of the present disclosure are described in detail below, and examples of the embodiments are shown in the attached drawings, throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

In the description of the present disclosure, it should be understood that the orientation or position relations indicated with the terms "center", "longitudinal", "transverse", "length", "width", "thickness", "up", "down", "front", "rear", "left", "right", "vertical", "horizontal", "top", "bottom" "inner" and "outer", "clockwise", "counterclockwise", "axial", "radial" or "circumferential" are based on the orientation or position relationships shown in the attached drawings, are used only for the convenience of describing the present disclosure and simplifying the description, rather than indicating or implying that the device or element referred to must have a particular orientation, be constructed and operated in a particular orientation, so they shall not be construed as a restriction on the present disclosure. In addition, a feature defined as "first" or "second" may, explicitly or implicitly, include one or more such features. Unless otherwise stated, "multiple" means two or more in the description of the present disclosure.

In the description of the present disclosure, it should be noted that unless otherwise expressly specified and defined, the terms "installation", "linking" and "connection" shall be understood generally, for example, it may be fixed connection, detachable connection, or integral connection; or mechanical or electrical connections; or direct linking, indirect linking through an intermediate medium, or internal connection of two components. The specific meaning of the above terms in the present disclosure may be understood on a case by case basis by ordinary technical personnel in this field.

The door assembly 10 of the air conditioner indoor unit 100 according to embodiments of the present disclosure will be described below with reference to FIGS. 1-14.

The door assembly 10 of the air conditioner indoor unit 100 according to embodiments of the present disclosure includes the door mounting plate 11, the door 12 and the driving assembly 13 which is used to drive the door 12.

The door mounting plate 11 is provided with the receiving chamber 111, where the receiving chamber 111 has the fitting opening 112 on one side and has another side enclosed to form the bottom wall 113 of the receiving chamber 111, the door 12 can move in the directions toward and away from the door mounting plate 11, and is mounted at the bottom wall 113 near the receiving chamber 111, there are multiple driving assemblies 13 which all are mounted in the receiving chamber 111, one end of each driving assembly 13 penetrates through the bottom wall 113 of the receiving chamber 111 and then is connected to the door 12, and multiple driving assemblies 13 are arranged uniformly on the door 12 at one end. Optionally, such uniform arrangement means that the intervals at the connections between multiple driving assemblies 13 and the door 12 are equivalent, or the pattern formed by the connections between multiple driving assemblies 13 and the door 12 is an equilateral geometry or a circle or other regular shape, so that the driving force applied by multiple driving assemblies 13 to the door 12 is uniform, ensuring the stable movement of the door 12.

For the door assembly 10 of the air conditioner indoor unit 100 according to embodiments of the present disclosure, the driving assembly 13 is mounted in the receiving chamber 111 which protects the former from being displaced or damaged after being subjected to the external force or violence, thereby extending the life of the door assembly 10. Further, one end of each driving assembly 13 penetrates through the bottom wall 113 of the receiving chamber 111, and then is connected to the door 12, that is, there is a solid wall between the driving assembly 13 and the door 12, so that the bottom wall 113 may support the driving assembly 13 to some extent after one end of the driving assembly 13 penetrates through the bottom wall 113 of the receiving chamber 111, which thus can enhance the stability of the driving assembly 13 driving the door 12. Moreover, the door 12 is driven by several driving assemblies 13, which improves the moving stability of the door 12 further, and reduces the torque of each driving assembly 13, thus lowering the noise of the door assembly 10.

The following will describe the door assembly 10 of the air conditioner indoor unit 100 according to embodiments of the present disclosure with reference to the attached drawings.

Optionally, as shown in FIGS. 1-5, the door mounting plate 11 includes: the frame 114, the mounting part 115 and the connection member 116. As shown in the attached drawing, the frame 114 is provided with the vent channel 1141 which penetrates through the frame 114 in the front-rear direction, and allows the air to pass through; the cross section of the vent channel 1141 may be approximately circular, and the shape of the door 12 is same to that of the vent channel 1141.

Figure 2:
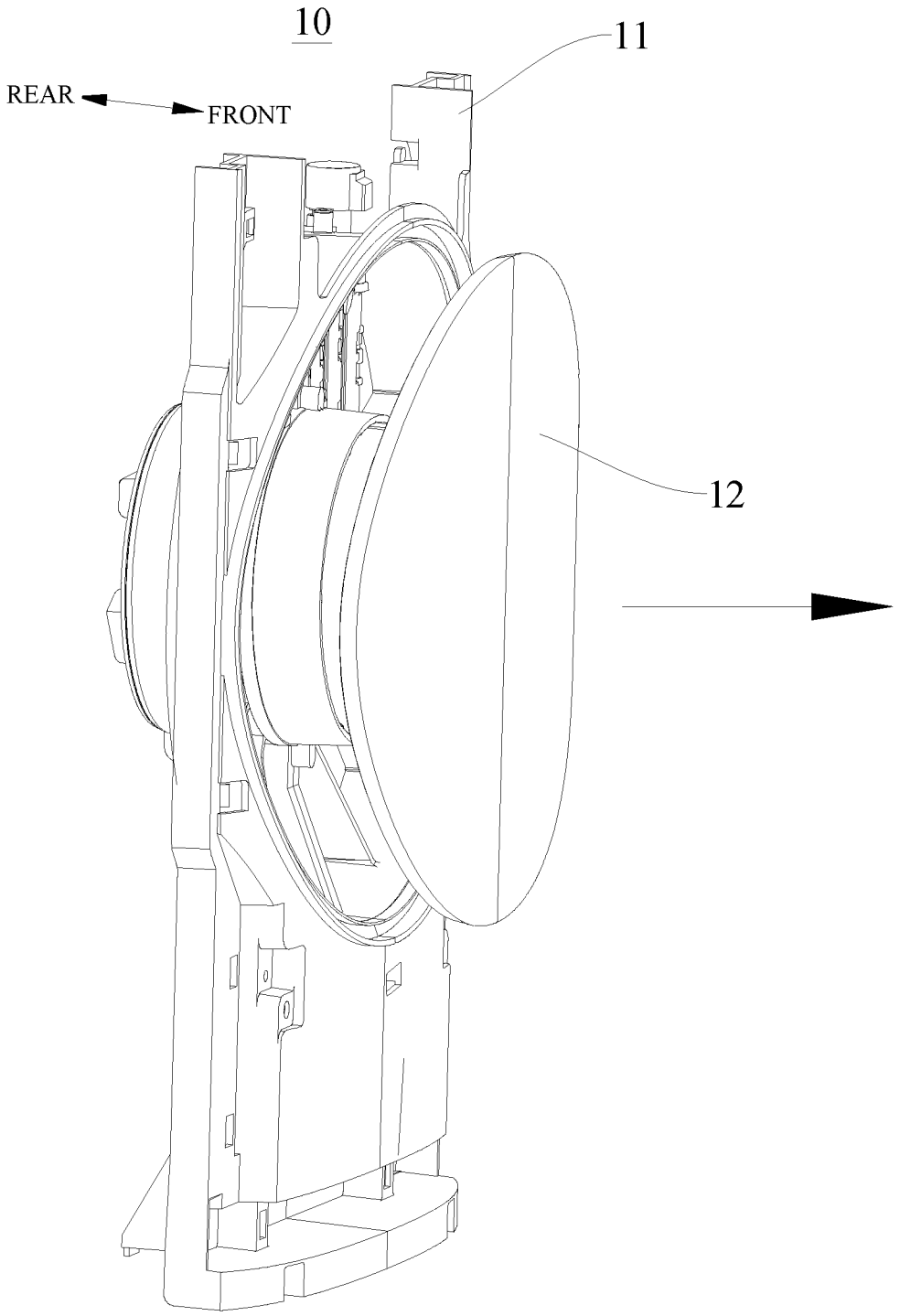
FIG. 2 is a structural diagram of the door assembly according to embodiments of the present disclosure, in which the door is in open state.

In this case, FIG. 1 is the structural diagram of the door assembly 10 according to embodiments of the present disclosure, where the door 12 is in the closed state in which the door 12 will close the vent channel 1141; FIG. 2 is the structural diagram of the door assembly 10 according to embodiments of the present disclosure, where the door 12 is in the open state in which the door 12 will open the vent channel 1141, and the arrow in FIG. 2 indicates the opening direction of the door 12. In the embodiment of the present disclosure, the door 12 may move in the front-rear direction. The front-rear direction herein may be construed as that the side facing the customer is the front side of the air conditioner indoor unit 100, while the side facing the mounting wall surface is the rear side of the air conditioner indoor unit 100, after the air conditioner indoor unit 100 is mounted.

The vent channel 1141 accommodates the mounting part 115. The receiving chamber 111 is formed at the mounting part 115 and the fitting opening 112 of the receiving chamber 111 is located at the side of the mounting part 115 away from the door 12. Optionally, the fitting opening 112 of the receiving chamber 111 is located at the rear side of the mounting part 115, while the driving assembly 13 is mounted in the receiving chamber 111 through the fitting opening 112 from the back to the front. The front end of the driving assembly 13 penetrates through the bottom wall 113 of the receiving chamber 111 and then is connected to the door 12.

In this case, the connection member 116 is arranged between the outer wall of the mounting part 115 and the inner wall of the vent channel 1141, and is connected between the frame 114 and the mounting part 115 so as to fix the mounting part 115 in the vent channel 1141. Optionally, as shown in FIGS. 3-5, there are several connection members 116 which are connected between the mounting part 115 and the inner wall of the vent channel 1141 in radial pattern, that is, several connection members 116 are spaced apart from one another in the circumferential direction and mounted in radial pattern around the mounting part 115, thereby ensuring the stability of connection structure between the mounting part 115 and the frame 114.

Figure 3:
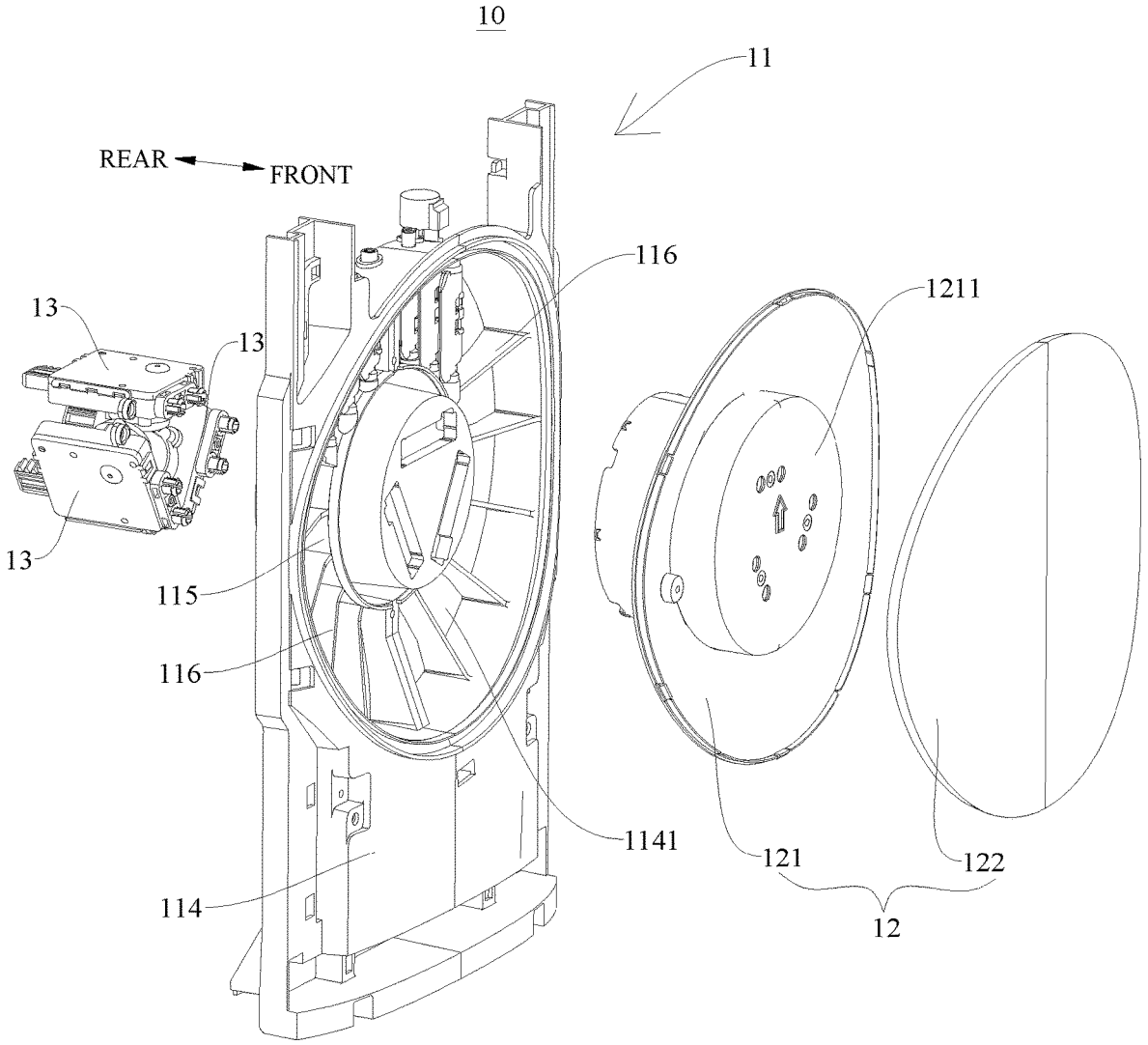
FIG. 3 is an exploded view of the door assembly according to embodiments of the present disclosure.
Figure 4:
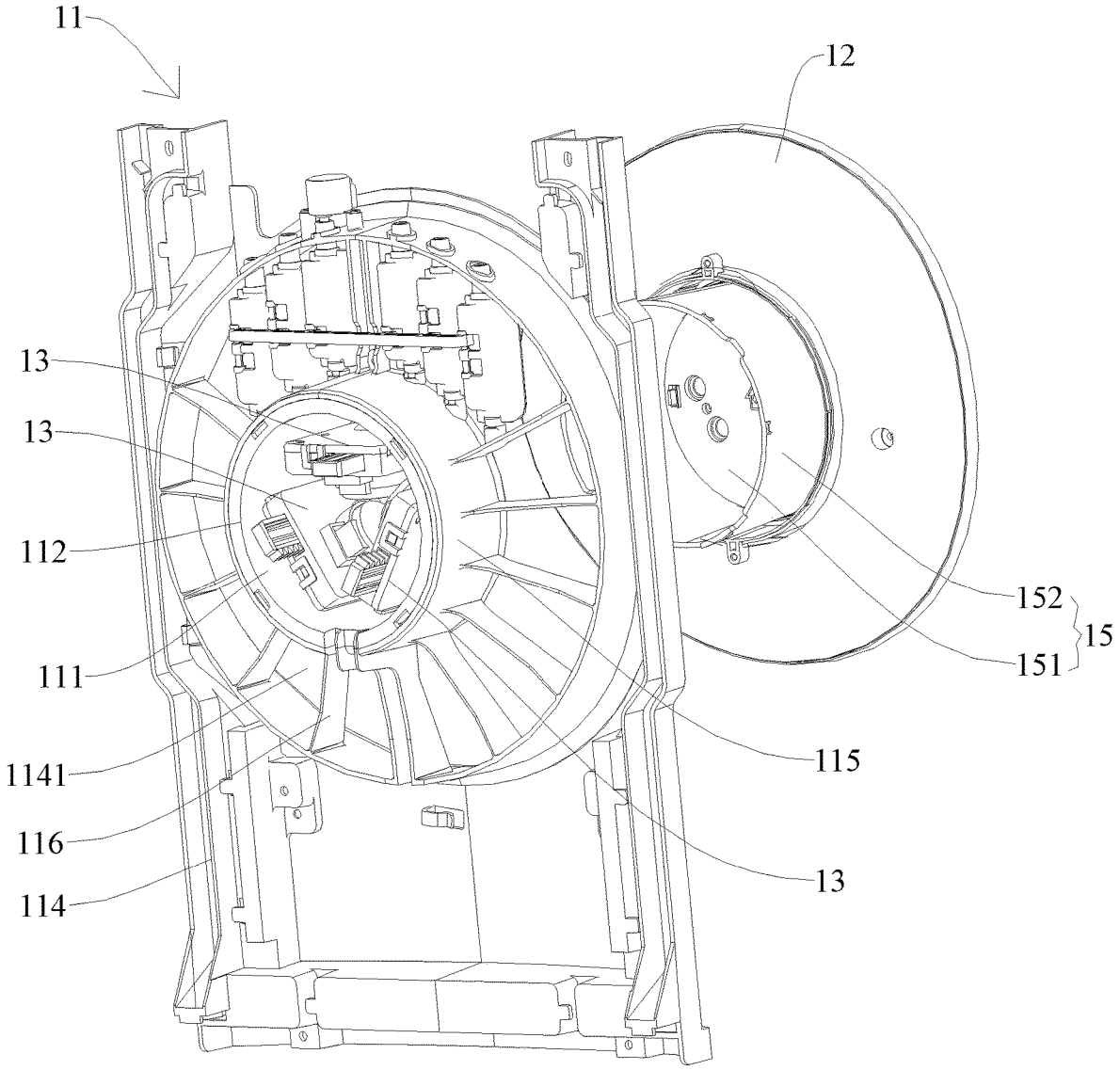
FIG. 4 is an exploded view of the door assembly from another angle according to embodiments of the present disclosure.
Figure 5:
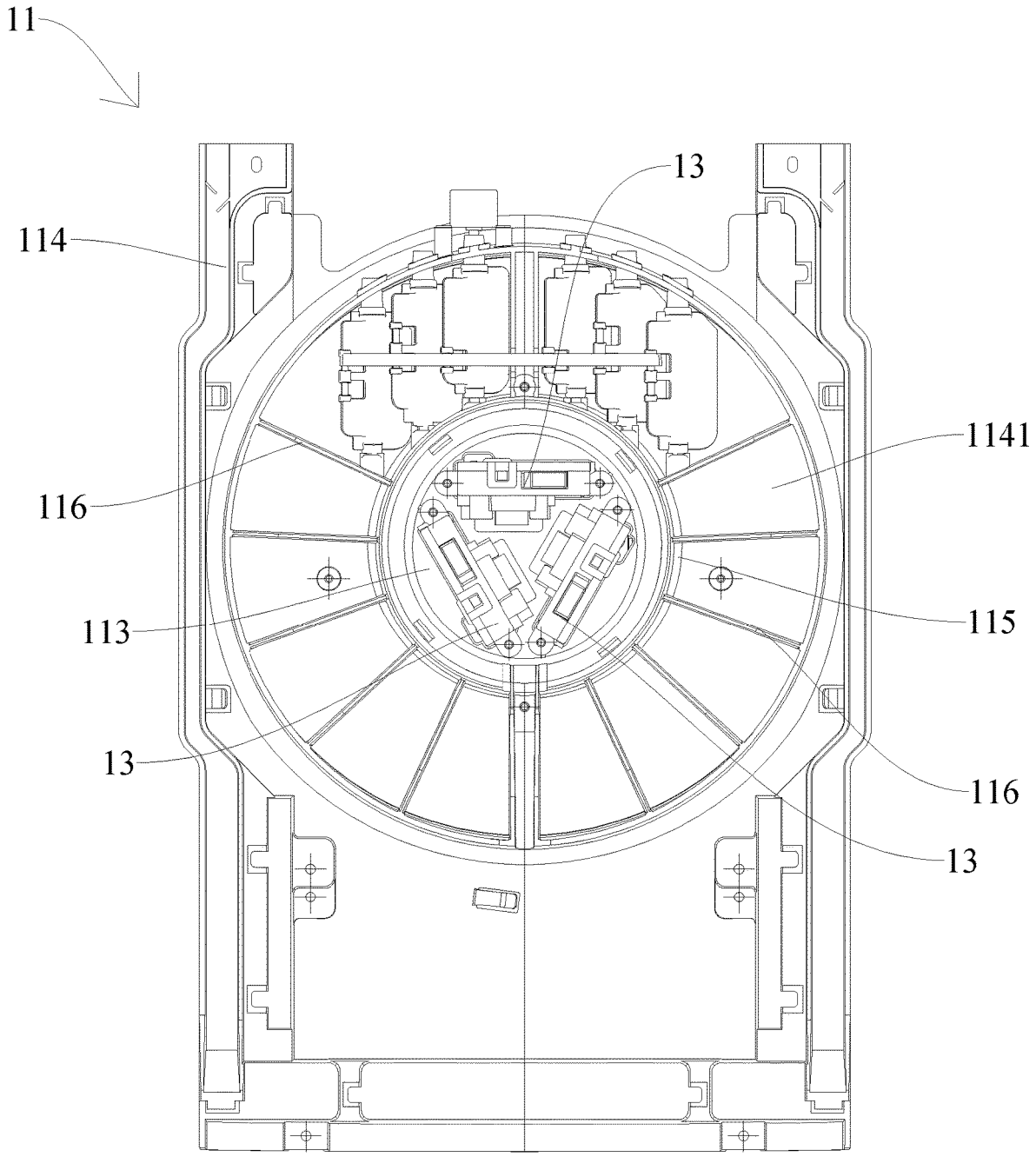
FIG. 5 is a rear view of the door assembly according to embodiments of the present disclosure.

Optionally, as shown in FIGS. 3-5, there are three driving assemblies 13 which are mounted along three edges of equilateral triangle respectively. In other word, each driving assembly 13 may be formed as an approximately linear structure; i.e., the cross section of each driving assembly 13 may be a flat structure, three driving assemblies 13 may be arranged along three edges of an equilateral triangle respectively, so that the positions of three driving assemblies 13 will form into a stable triangle; after being connected to the door 12, the connections with the door 12 also will form a triangle; therefore, the opening-closing motion of the door 12 will become more stable.

Of course, the present disclosure is not limited to this, as long as the ends of three driving assembly 13 are evenly arranged at the door 12; the three driving assemblies 13 can also be formed as other regular shapes, such as circle, ellipse and other regular polygons, as long as the external force exerted by the three driving assemblies 13 on the door 12 is evenly distributed.

Of course, the present disclosure is not limited to this. The quantity of the driving assemblies 13 may be two, four, five and even more.

Optionally, the structures of the driving assemblies 13 are the same, which on the one hand increases the universality of parts and reduces the number of parts requiring mold opening; on the other hand, it can also improve the production efficiency.

Figure 9:
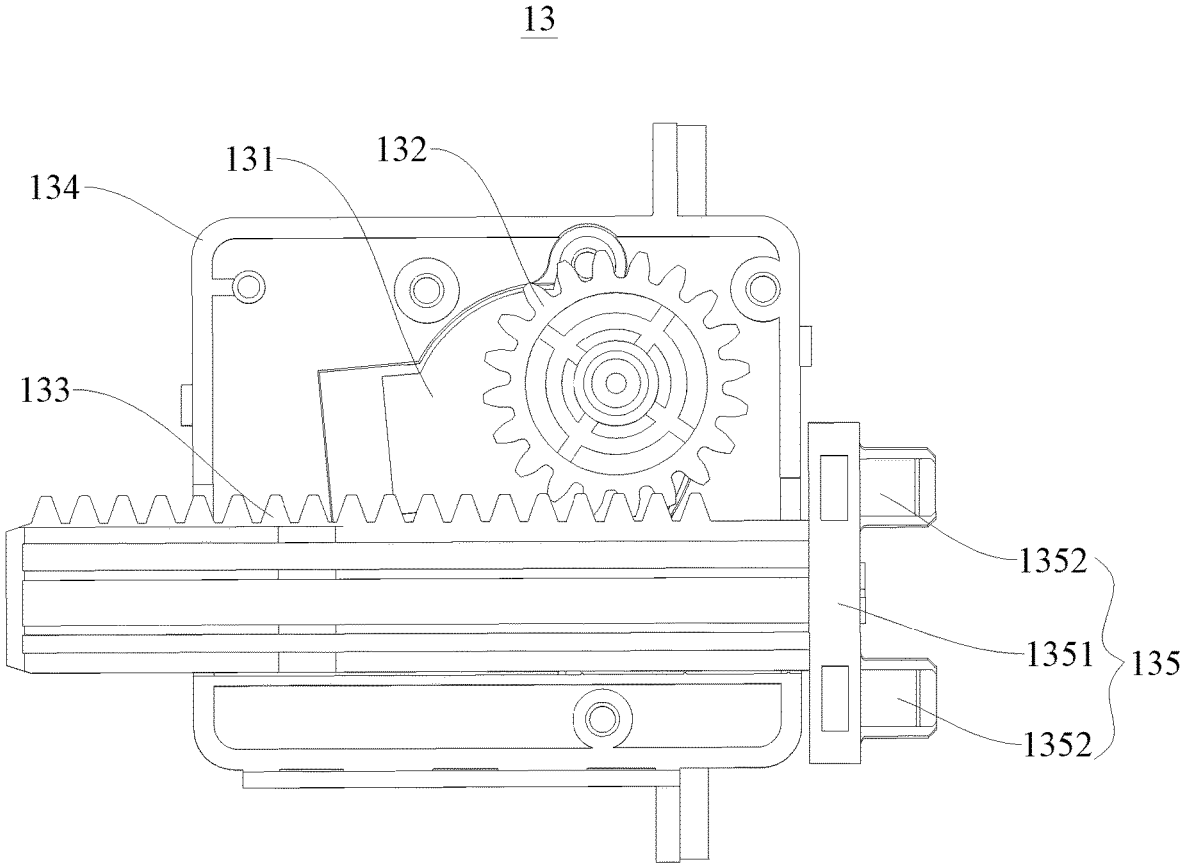
FIG. 9 is a structural diagram of the driving assembly according to embodiments of the present disclosure.

As shown in FIG. 9, the driving assembly 13 optionally includes the motor 131, the gear 132 and the rack 133, where the gear 132 is sleeved on the shaft of the motor 131, the rack 133 extends along the moving direction of the door 12 and meshes with the gear 132, and one end of the rack 133 penetrates through the bottom wall 113 of the receiving chamber 111 and then is connected to the door 12. With the structure including gear 132 and rack 133 as the driving assembly 13, the driving structure is simple and the driving torque is stable.

As shown in FIG. 9, the driving assembly 13 also includes the housing 134, the motor 131 and the gear 132, where all of them are mounted in the housing 134, the rack 133 is movable in the housing 134, and both ends of the rack 133 penetrate through the housing 134 respectively. The motor 131, the gear 132 and the rack 133 can be protected by the housing 134, so as to ensure the structural stability of the driving assembly 13 and protect it from being damaged by the external force. Moreover, the housing 134 allow the mounting of the driving assembly 13 on the door mounting plate 11 to be more flexible.

Optionally, the gear 132 rotates to drive the rack 133 moving in the moving direction of the door 12, that is, to drive the rack 133 to move in the front-rear direction, so that the rack 133 can be used to drive the door 12 to move.

Optionally, the driving assembly 13 also includes: the connection part 135 which is mounted at the end of the rack 133 adjacent to the door 12, and is connected to the door 12. With the connection part 135, it becomes convenient to connect the rack 133 to the door 12.

Optionally, the connection part 135 includes the connection plate body 1351 and the connection column 1352, where one side of the connection plate body 1351 is connected vertically to the rack 133, while the connection column 1352 is located at the other side of the connection plate body 1351 and detachably connected to the door 12. As shown in FIG. 9, the rear side of the connection plate body 1351 is vertically connected to the rack 133, and the front side of the connection plate body 1351 is provided with the connection column 1352. The connection part 135 can penetrate through the bottom wall 113 of the receiving chamber 111 and then connected to the door 12; as shown in FIG. 10 and FIG. 14, when the door 12 is in the open state, a part of the rack 133 can also be moved forward out of the receiving chamber 111.

Figure 10:
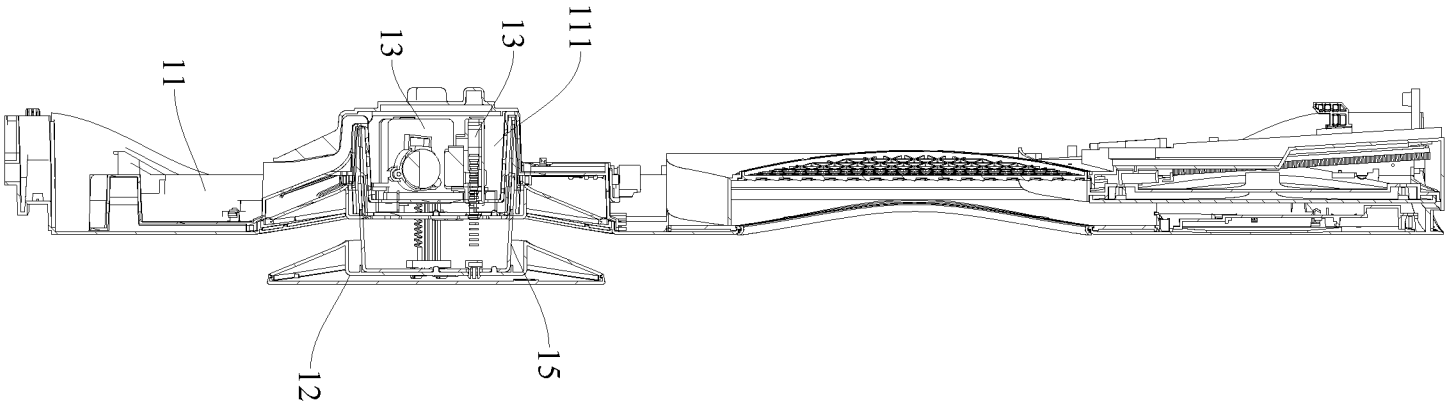
FIG. 10 is a cross-sectional view of the door assembly according to embodiments of the present disclosure.
Figure 14:
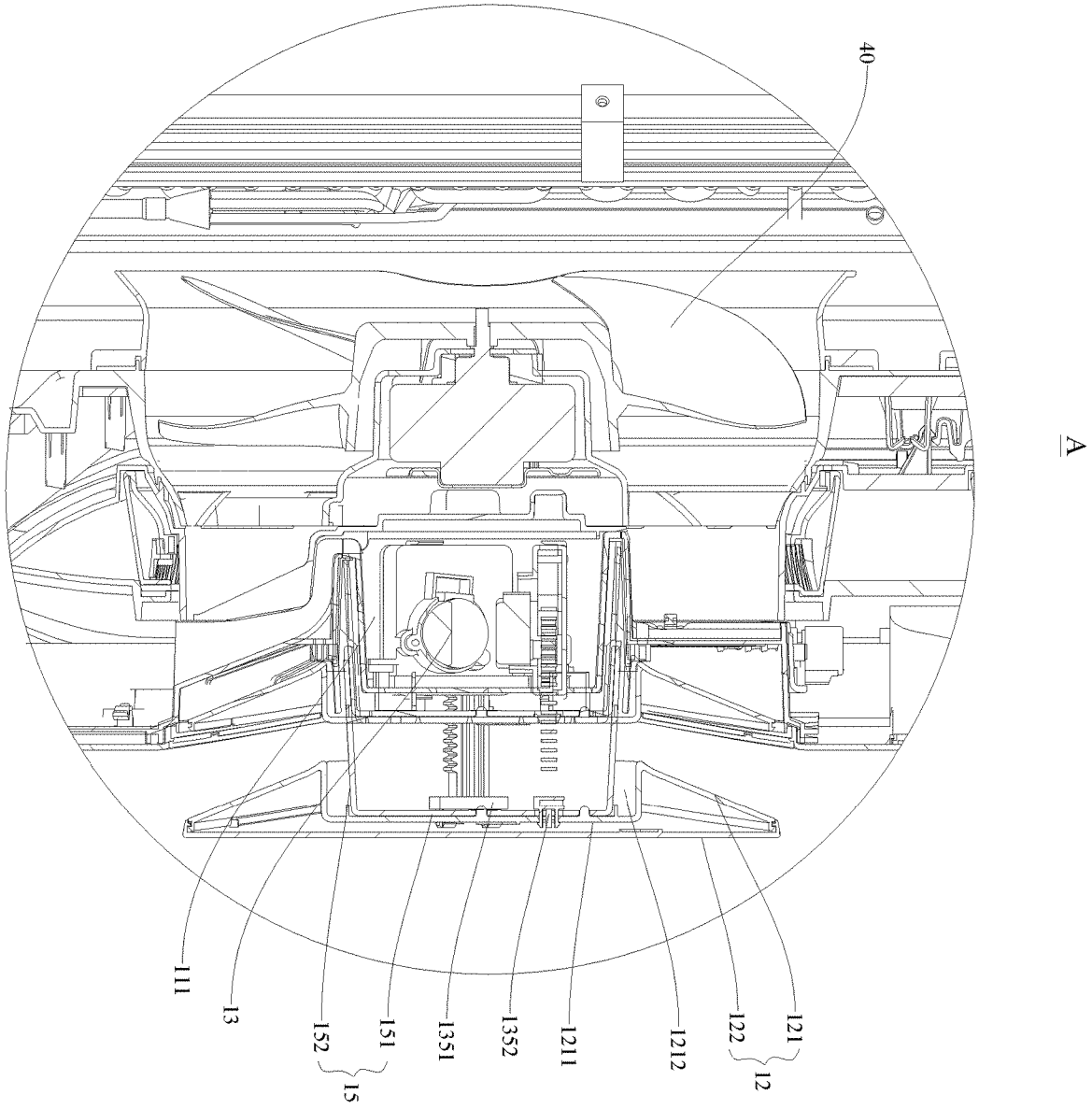
FIG. 14 is an enlarged view of area A in FIG. 13, where

As shown in FIGS. 10 and 14, the front side of the connection plate body 1351 can also contact with the rear wall of the door 12, which can improve the stability of the connection structure with the door 12 and avoid shaking between the door 12 and the connection part 135.

Optionally, there may be several connection columns 1352, at least one of which can be connected to the door 12 through the clip structure, and at least one of them can be connected to the door 12 through the threaded connection member. In other word, the connection part 135 can be connected to the door 12 both through threaded connection member and clip structure, thereby improving the connecting stability.

Figure 11:
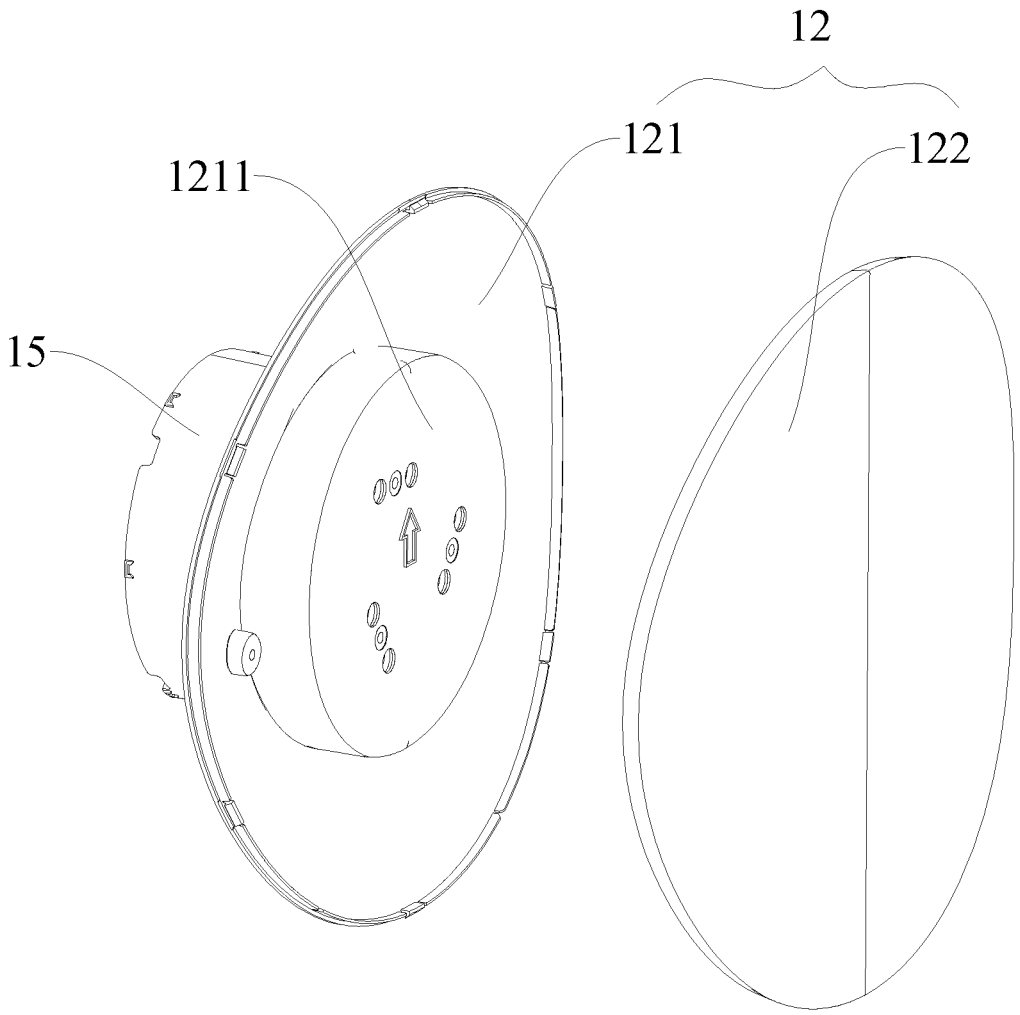
FIG. 11 is an exploded view of the door assembly according to embodiments of the present disclosure.

Optionally, the door assembly 10 is shown in FIG. 11, which is characterized in that the door 12 includes the baseplate 121 and the cover plate 122, where the cover plate 122 is mounted at the side of the baseplate 121 away from the door mounting plate 11, and the cover plate 122 is detachable relative to the baseplate 121. A cavity is formed between the baseplate 121 and the cover plate 122, which on the one hand can improve the strength of the door assembly 10, and on the other hand can prevent condensate drops from forming on the surface of the door 12 during cooling operation.

As shown in FIG. 10, FIG. 11 and FIG. 14, the door assembly 10 also includes the guiding part 15, where the guiding part 15 is mounted at the side of the baseplate 121 near the door mounting plate 11 at which guiding groove is formed, and the guiding part 15 is movable in the guiding groove. The matching structure between the guiding part 15 and the guiding groove improves the moving smoothness of the door 12 in the front-rear direction, so that the door 12 can open or close the vent channel 1141 smoothly without shaking.

As shown in FIG. 10, FIG. 11 and FIG. 14, the baseplate 121 is optionally provided with the projection part 1211 in the middle projecting toward the cover plate 122, where the mounting groove 1212 is formed at the side of the projection part 1211 away from the cover plate 122, and the guiding part 15 is mounted in the mounting groove 1212. Thus, the mounting structure of the guiding part 15 on the baseplate 121 is stable. Optionally, the baseplate 121 is connected to the guiding part 15 in a detachable manner, so that it becomes convenient to replace the corresponding component.

Optionally, the guiding part 15 includes the end wall 151 and the peripheral wall 152 mounted in the circumferential direction of the end wall 151, where the end wall 151 and a part of the peripheral wall 152 are accommodated in the mounting groove 1212, and the peripheral wall 152 can be mounted movably in the guiding groove. As shown in FIG. 14, the front part of the peripheral wall 152 can be accommodated in the mounting groove 1212, while the rear part of the peripheral wall 152 can move in the guiding groove.

Optionally, as shown in FIG. 14, the baseplate 121 of the door 12 can fit with and be connected to the end wall 151 of the guiding part 15 through projection-groove structure, and the baseplate 121 of the door 12 fits with the end wall 151 of the guiding part 15. The connection column 1352 of the connection part 135 can penetrate through the baseplate 121 of the door 12 and the end wall 151 of the guiding part 15 at the same time, so as to be connected to the door 12; optionally, the connection plate body 1351 can fit the end wall 151 of the guiding part 15.

Figure 6:
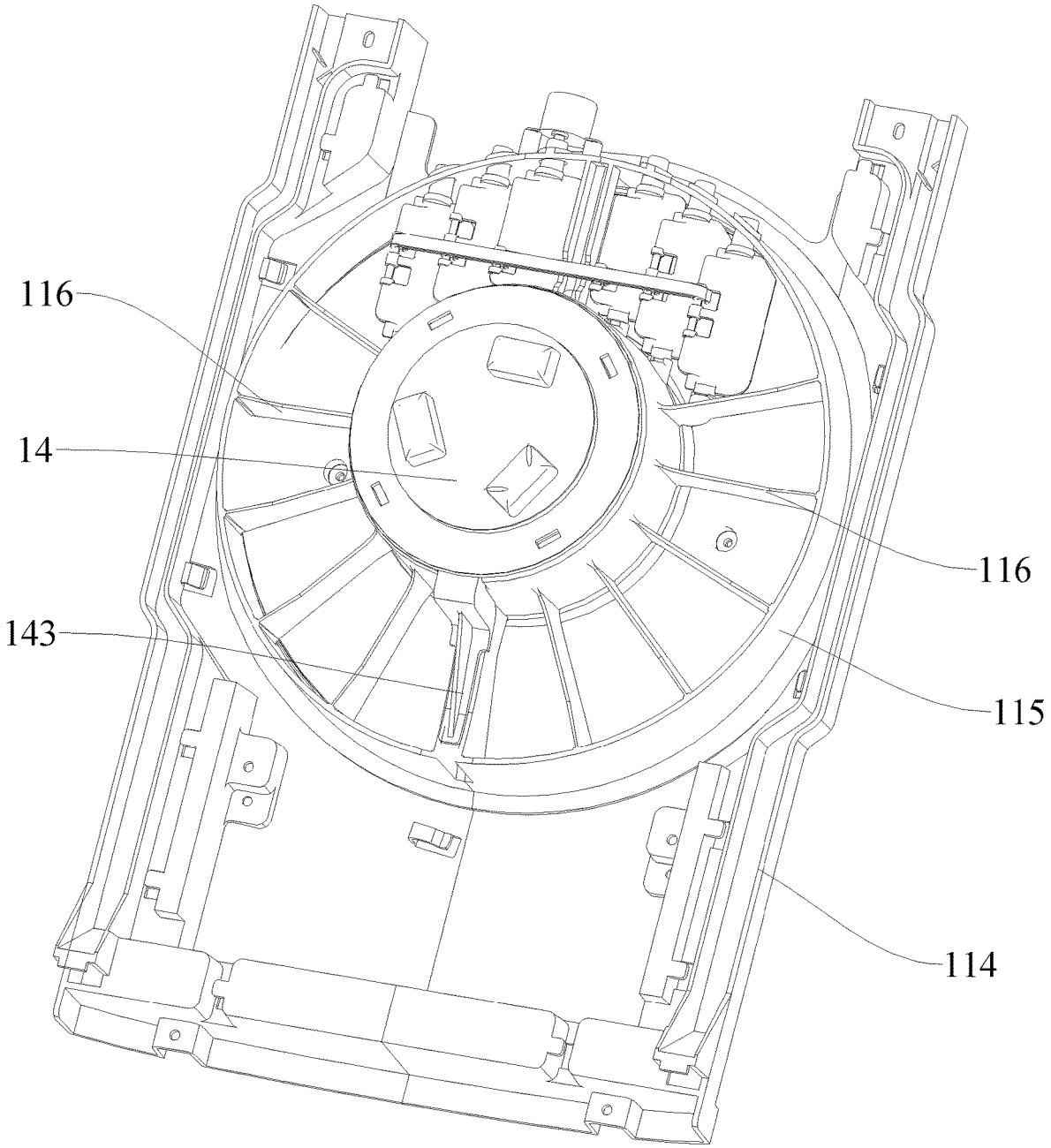
FIG. 6 is a structural diagram of the door assembly according to embodiments of the present disclosure, showing the matching structure of the seal cover and the door mounting plate.
Figure 7:
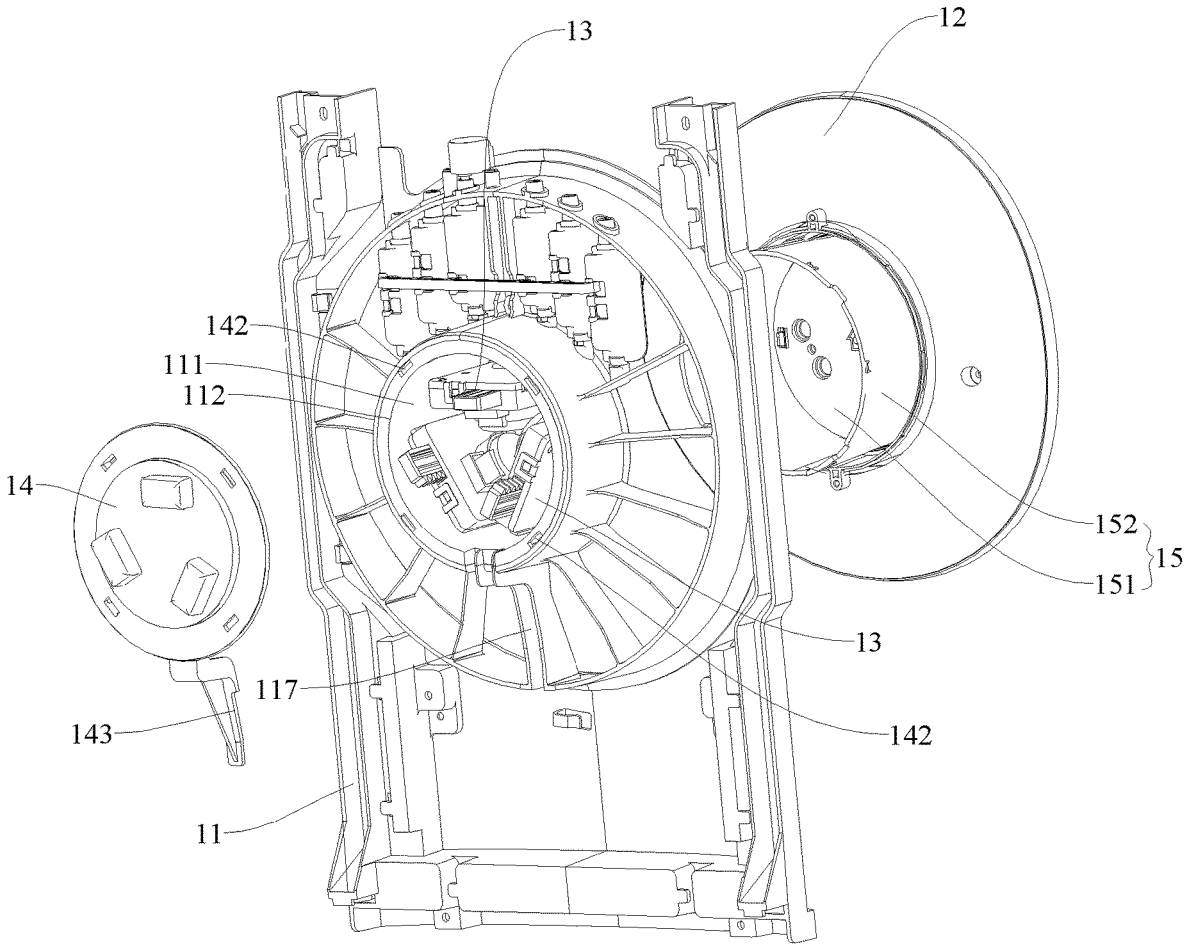
FIG. 7 is an exploded view of the door assembly according to embodiments of the present disclosure, showing the structure of the seal cover.
Figure 8:
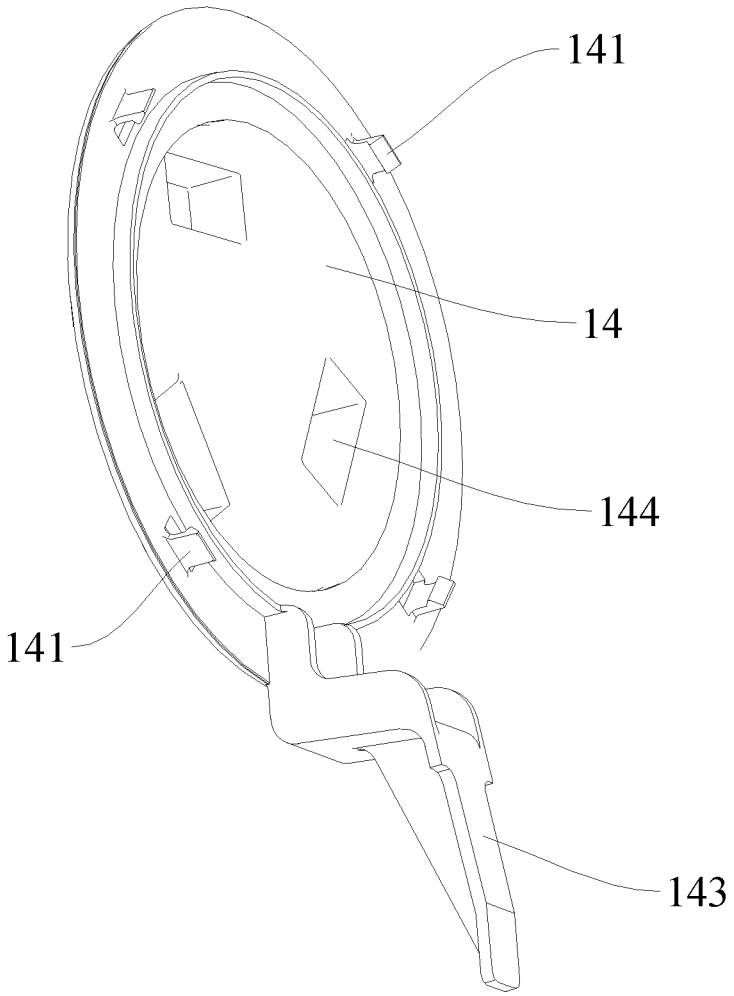
FIG. 8 is a structural diagram of the seal cover according to embodiments of the present disclosure.

In the optional embodiment of the present disclosure, as shown in FIGS. 6-8, the door assembly 10 also can include the seal cover 14 which is mounted at the door mounting plate 11 and covers the fitting opening 112 of the receiving chamber 111.

The seal cover 14 is provided to cover the fitting opening 112 of the receiving chamber 111, so as to prevent the air after heat exchange entering the receiving chamber 111 when the air conditioner is running, and avoid the cool air being blown into the cavity forming condensate, thereby improving the airtightness of the operating space of the driving assembly 13, which can extend the service life of the driving assembly 13, and meanwhile prevent the exposed wires being touched by any personnel, thus improving the operation safety of the machine.

Optionally, as shown in FIGS. 6-8, the seal cover 14 and the door mounting plate 11 are detachably connected to each other. Thus, the seal cover 14 can be detached conveniently to overhaul the driving assembly 13. Optionally, the seal cover 14 can be connected to the door mounting plate 11 through the threaded connection member or the clip structure.

Optionally, either the seal cover 14 or the door mounting plate 11 is provided with the clip 141, while another is configured with the clamping groove 142, so that the clip 141 can be clamped into the clamping groove 142. Therefore, the seal cover 14 and the door mounting plate 11 can be installed and detached conveniently, reducing the use of the tools.

Further, as shown in FIG. 7, the fitting opening 112 on the door mounting plate 11 around the receiving chamber 111 can be optionally configured with several clamping grooves 142, while the side of the seal cover 14 facing the door mounting plate 11 can be provided with several clips 141, so that the clips 141 can be clamped into the clamping grooves 142 correspondingly. Thus, the seal cover 14 and the door mounting plate 11 are installed through multiple sets of clip-groove structure, which makes the installation structure more stable, not easy to be separated from each other.

Further, several clamping grooves 142 are formed on the mounting part 115 of the door mounting plate 11. In this case, as shown in FIG. 7, several clamping grooves 142 can be formed on the rear end face of the mounting part 115, and arranged in the circumferential direction around the fitting opening 112 of the receiving chamber 111. Therefore, the seal cover 14 is connected to the mounting part 115 with the help of clip 141, and covers the fitting opening 112 of this receiving chamber 111. Now, the mounting part 115 and the seal cover 14 seal the receiving chamber 111, so that the receiving chamber 111 will become an atmosphere relatively isolated from the ambient, so as to ensure the configuration safety of the driving assembly 13.

As shown in FIGS. 6 and 7, the wiring channel 117 is provided at the door mounting plate 11 and is connected to the receiving chamber 111. In this case, the wiring channel 117 is used to accommodate the wires connecting the driving assembly 13 to the external power supply; by providing the wiring channel 117, the wires can be installed conveniently, and be protected from being damaged by the external force, thereby enhancing the safety. Optionally, the opening of the wiring channel 117 is toward the same orientation with the fitting opening 112 of the receiving chamber 111.

Optionally, as shown in FIGS. 6-8, the wiring channel cover plate 143 is provided at the seal cover 14, and covers the wiring channel 117. With the wiring channel cover plate 143, the wires can be prevented from being exposed and being touched by any personnel, so as to lower the potential safety hazards and satisfy the safety requirements.

Optionally, as shown in FIGS. 6-8, the projection groove 144 projecting toward the direction away from the receiving chamber 111 is provided at the seal cover 14, and can accommodate the rack 133. While the driving assembly 13 is driving the door 12 to move in the front-rear direction, the rack 133 will also move in the front-rear direction; the projection groove 144 is provided at the seal cover 14 to provide the avoiding space for the movement of the rack 133, thereby reducing the volume of the receiving chamber 111 and improving the space utilization of the product.

Figure 12:
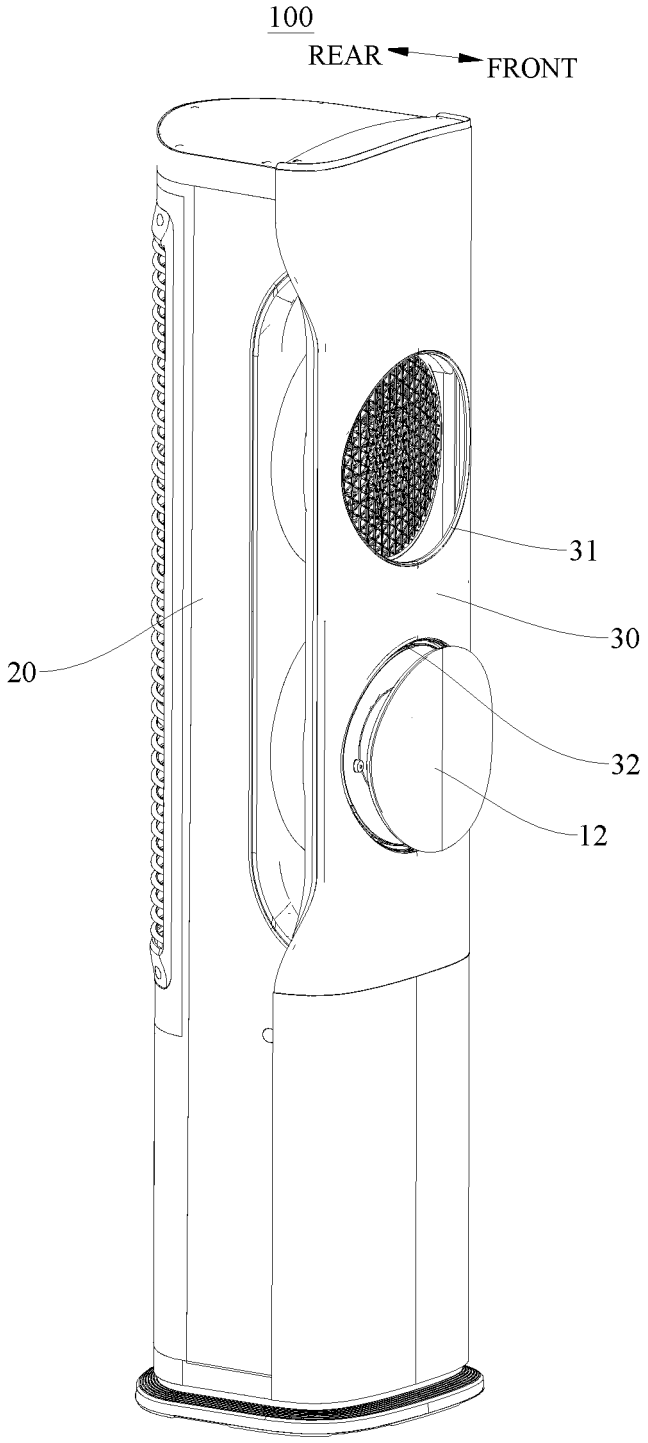
FIG. 12 is a structural diagram of the air conditioner indoor unit according to embodiments of the present disclosure.
Figure 13:
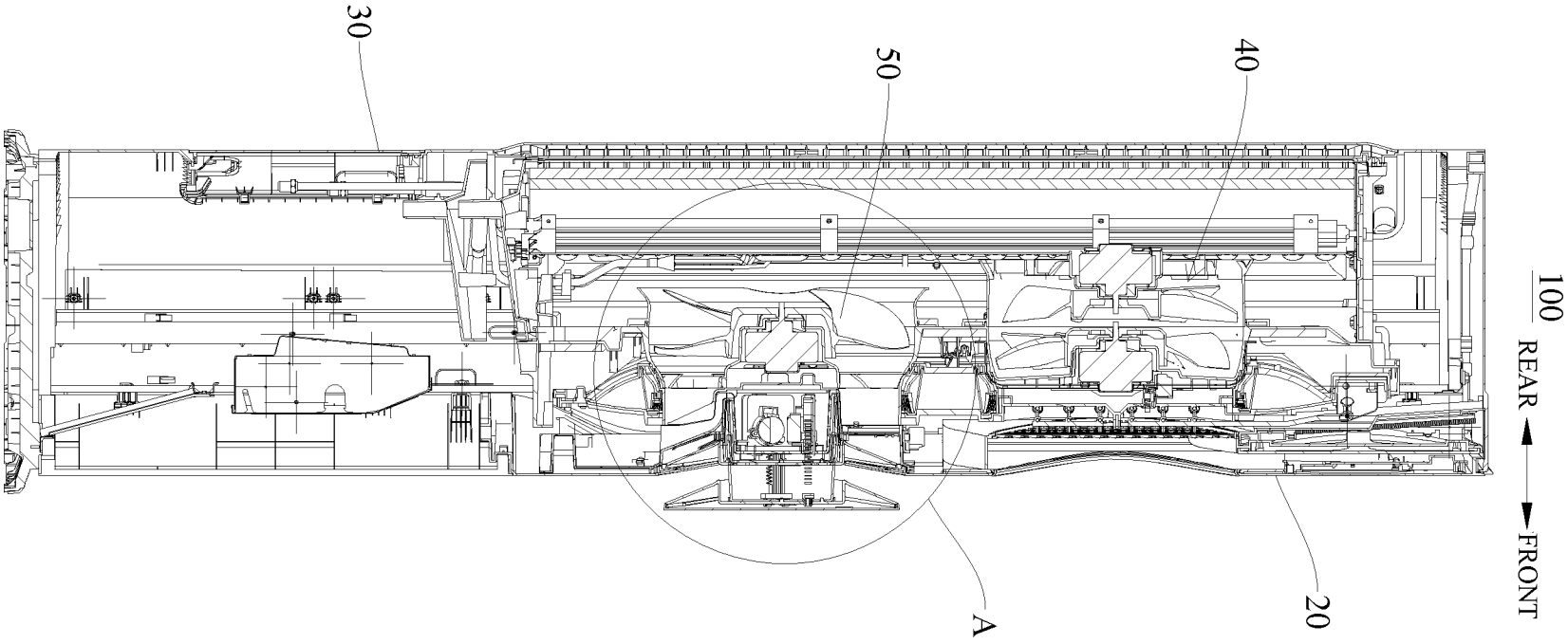
FIG. 13 is a cross-sectional view of the air conditioner indoor unit shown in FIG. 12.

The following part will describe the air conditioner indoor unit 100 according to the second embodiment of the present disclosure with reference to the FIGS. 12-14, where it should be noted that the air conditioner indoor unit 100 may be floor-mounted or wall-mounted.

The air conditioner indoor unit 100 according to embodiments of the present disclosure includes: the outer box baseplate component 20, the panel component 30 and the door assembly 10 of the air conditioner indoor unit 100. In this case, the door assembly 10 of the air conditioner indoor unit 100 is the door assembly 10 of the air conditioner indoor unit 100 according to the first embodiment of the present disclosure.

The outer box baseplate component 20 has one side open, on which the panel component 30 is mounted; the panel component 30 is provided with the air outlet. The door mounting plate 11 is mounted at the side of the panel component 30 facing the outer box baseplate component 20, and the door 12 can open or close movably the air outlet; when the door 12 opens the air outlet, the door 12 will be located at the side of the panel component 30 away from the outer box baseplate component 20.

In this case, the vent channel 1141 on the door mounting plate 11 is mounted in alignment with this air outlet; in the open state, the door 12 opens the vent channel 1141 and the air outlet; that is, the air outlet can be closed when the air conditioner indoor unit 100 stops, to prevent the foreign matters entering the air conditioner indoor unit 100. In the closed state, the door 12 opens the air outlet and the vent channel 1141, so that the air conditioner indoor unit 100 can work normally, and the conditioned air discharged through the air outlets can be used to condition the indoor environment.

Since the door assembly 10 according to embodiments of the present disclosure has the above advantages, this door assembly 10 can be configured to enable the air conditioner indoor unit 100 to have the corresponding advantages, i.e. the door 12 can open or close the air outlet more smoothly and stably, move steadily at low noise, and the service life of the air conditioner indoor unit 100 can be extended.

Optionally, the panel component 30 may be provided with several air outlets. The air conditioner indoor unit 100 may include several fans which are corresponding to the air outlets respectively. Optionally, as shown in FIG. 12, there are two air outlets, where the first air outlet 31 is corresponding to the first fan 40, while the second air outlet 32 is corresponding to the second fan 50. In this case, the door assembly 10 is mounted at the second air outlet 32 correspondingly to open or close the second air outlet 32.

The first fan 40 includes the counter-rotating fan including the first wind wheel 51 and the second wind wheel 51, which means that the tilting direction of the blade of the first wind wheel 51 is opposite to that of the second wind wheel 51, and the first wind wheel 51 and the second wind wheel 51 guide each other in the direction of air flow, which reduces (when the first wind wheel 51 and the second wind wheel 51 rotate at different speeds) or eliminate (when the first wind wheel 51 and the second wind wheel 51 rotate at the same speed) the tangential rotation speed of airflow (that is, the dynamic pressure is converted to static pressure), and improves the work efficiency of the counter-rotating fan; and the air from two wind wheels 51 flows to the direction of air outlet, so as to realize long-distance air supply. It should be noted that the counter-rotating fan could realize air supply for longer distance no matter whether the first wind wheel 51 and the second wind wheel 51 rotate at the different speeds or the same speed, as compared with the single cross-flow fan, axial-flow fan or diagonal fan.

Secondly, the delivery range of the cool air can be expanded when the first wind wheel 51 and the second wind wheel 51 rotate at the different speeds. Since when one wind wheel 51 rotates at higher speed and another wind wheel 51 rotates at lower speed, the wind wheel 51 of higher speed plays a leading role, and deviates from the rotation axis according to air outlet angle of the blades of single-stage axial-flow or diagonal fan, so that the axial wind wheel 51 or oblique wind wheel 51 itself has air distribution effect; thus, the angle range of cool air from the first air outlet 31 will be expanded to realize air supply in a larger angle range. Besides, on the basis of the air distribution effect of the axial wind wheel 51 or oblique wind wheel 51 itself, the rotation speeds of the first wind wheel 51 and the second wind wheel 51 can be adjusted according to the demands to make them rotate at different speeds, thus realizing gentle breeze or breezeless air supply, and preventing the cool air being blown directly to the users through the first air outlet 31, causing bad experience to the user. Therefore, the air conditioner indoor unit 100 in the embodiment of this utility model can realize gentle breeze or breezeless air supply without the air deflector with micro holes, so that the air loss is small. It should be noted that the motor 131 corresponding to either wind wheel 51 may be deactivated while another wind wheel 51 still supplies air forwards to the side of the first air outlet 31 in order to realize wide-angle air supply and breezeless air supply. In addition, either wind wheel 51 can supply air reversely to the inner side of the panel component while another wind wheel 51 supplies air forwards for realizing wide-angle air supply and breezeless air supply. In this case, "forward air supply" means that the air is blown out from the first air outlet 31 under the effect of the wind wheel 51, while "reverse air supply" means that the air is blown toward the inner side of the panel component.

Optionally, as shown in FIGS. 13 and 14, the air conditioner indoor unit 100 also includes the motor protection part 53, where the second fan 50 is mounted at the side of the door assembly 10 away from the panel component 30, and includes the wind wheel 51 which is mounted between the outer box baseplate component 20 and the panel component 30 and supplies air to the air outlet, and the driving motor 52 which is used to drive the wind wheel 51 to rotate, where the motor protection part 53 is arranged to cover the driving motor 52 and is open to the side of the motor protection part 53 towards the door assembly 10, and where at least a part of the seal cover 14 is accommodated in the motor protection part 53. It thus improves the structural compactness of the product further.

Optionally, the cover of motor protection part 53 can contact with the seal cover 14; for example, the front end of the cover of motor protection part 53 can contact with the rear end face of the seal cover 14, so that the cover of the motor protection part 53 can produce pressure against the seal cover 14, and thus improve the installation stability of the seal cover 14.

In the description of the present disclosure, the terms "an embodiment", "some embodiments" and "schematic embodiment", "example", "specific example", or "some examples" etc. means that the specific feature, structure, material or characteristic of that embodiment or example described are included in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples. Although the embodiments of the present disclosure have been presented and described, the ordinary technical personnel in the field can understand that multiple changes, modifications, substitutions and variations of such embodiments can be made without deviating from the principles and purposes of the present disclosure, and that the scope of the invention is defined by the claims and their equivalents.

What is claimed is:

1. A door assembly for an air conditioner indoor unit, comprising:

a door mounting plate including:

a receiving chamber having a fitting opening on one side and a bottom wall on another side; and a wiring channel connected to the receiving chamber and configured to accommodate wires;

a door arranged adjacent to the bottom wall of the receiving chamber and configured to be movable toward and away from the door mounting plate; and a plurality of driving assemblies arranged in the receiving chamber, each of the plurality of driving assemblies including a motor, a gear, and a rack, an end of each driving assembly passing through the bottom wall of the receiving chamber to be connected to the door, locations of the ends of the plurality of driving assemblies connected to the door being uniformly distributed on the door, and the plurality of driving assemblies being configured to drive the door to move; and a seal cover mounted at the door mounting plate and covering the fitting opening of the receiving chamber, the seal cover including:

a wiring channel cover plate configured to cover the wiring channel; and a plurality of projection grooves each projecting toward a direction away from the receiving chamber and accommodating the rack of one of the plurality of driving assemblies.

2. The door assembly according to claim 1, wherein:

the door mounting plate comprises:

a frame including a vent channel;

a mounting part provided in the vent channel; and a connection member connected between the frame and the mounting part to fix the mounting part in the vent channel;

the receiving chamber is formed in the mounting part; and the fitting opening of the receiving chamber is located at a side of the mounting part away from the door.

3. The door assembly according to claim 2, wherein the connection member is one of a plurality of connection members of the door mounting plate that are radially connected between the mounting part and an inner wall of the vent channel.

4. The door assembly according to claim 1, wherein the plurality of driving assemblies include three driving assemblies oriented along three edges of an equilateral triangle, respectively.

5. The door assembly according to claim 1, wherein for each of the driving assemblies:

the gear is sleeved over a motor shaft of the motor; and the rack extends along a moving direction of the door and is configured to mesh with the gear, an end of the rack passing through the bottom wall of the receiving chamber to be connected to the door.

6. The door assembly according to claim 5, wherein:

each of the driving assemblies further comprises a housing accommodating the motor and the gear; and the rack is movable in the housing, and both longitudinal ends of the rack extend out of the housing.

7. The door assembly according to claim 5, wherein each of the driving assemblies further comprises a connection part provided at an end of the rack adjacent to the door and connected to the door, the connection part comprising:

a connection plate body, a first side of the connection plate body being connected to and perpendicular to the rack; and a connection column provided at a second side of the connection plate body that is opposite to the first side, the connection column being detachably connected to the door.

8. The door assembly according to claim 7, wherein for each of the driving assemblies, the connection column is connected to the door through a snap structure.

9. The door assembly according to claim 7, wherein for each of the driving assemblies, the connection column is connected to the door through a threaded connection member.

10. The door assembly according to claim 7, wherein for each of the driving assemblies, the connection column is one of a plurality of connection columns of the connection part, one of the plurality of connection columns being connected to the door through a snap structure, and another one of the plurality of connection columns being connected to the door through a threaded connection member.

11. The door assembly according to claim 1, further comprising:

a guiding part;

wherein:

the door comprises:

a baseplate; and a cover plate arranged at a first side of the baseplate away from the door mounting plate and being detachable from the baseplate;

the door mounting plate includes a guiding groove; and the guiding part is arranged at a second side of the baseplate adjacent to the door mounting plate, and is movable in the guiding groove.

12. The door assembly according to claim 11, wherein:

the baseplate includes a projection part at a middle of the baseplate and projecting towards the cover plate, the projection part including a mounting groove at a side of the projection part away from the cover plate; and the guiding part is provided in the mounting groove.

13. The door assembly according to claim 12, wherein the guiding part comprises:

an end wall received in the mounting groove; and a peripheral wall circumferentially around the end wall and partially received in the mounting groove, the peripheral wall being movably arranged in the guiding groove.

14. The door assembly according to claim 11, wherein the baseplate is detachably connected to the guiding part.

15. An air conditioner indoor unit, comprising:

an outer box baseplate component having an open side;

a panel component arranged at the open side of the outer box baseplate component and including an air outlet; and a door assembly including:

a door mounting plate arranged at a side of the panel component towards the outer box baseplate component and including:

a receiving chamber having a fitting opening on one side and a bottom wall on another side; and a wiring channel connected to the receiving chamber and configured to accommodate wires;

a door arranged adjacent to the bottom wall of the receiving chamber and configured to be movable toward and away from the door mounting plate to open or close the air outlet, and configured to be located at a side of the panel component away from the outer box baseplate component when opening the outlet; and a plurality of driving assemblies arranged in the receiving chamber, each of plurality of driving assemblies including a motor, a gear, and a rack, an end of each driving assembly passing through the bottom wall of the receiving chamber to be connected to the door, locations of the ends of the plurality of driving assemblies connected to the door being uniformly distributed on the door, and the plurality of driving assemblies being configured to drive the door to move; and a seal cover mounted at the door mounting plate and covering the fitting opening of the receiving chamber, the seal cover including:

a wiring channel cover plate configured to cover the wiring channel; and a plurality of projection grooves each projecting toward a direction away from the receiving chamber and accommodating the rack of one of the plurality of driving assemblies.

* * * * *